United States Patent [19]

Bares

[11] Patent Number: 4,972,231

[45] Date of Patent: Nov. 20, 1990

[54] LINEARLY MOVABLE DEVELOPER UNIT MAGNET

[75] Inventor: Jan Bares, Webster, N.Y.

[73] Assignee: Xerox Corporation, Stamford, Conn.

[21] Appl. No.: 345,935

[22] Filed: May 1, 1989

[51] Int. Cl.[5] ..... G03G 15/09

[52] U.S. Cl. ..... 355/251; 118/658

[58] Field of Search ..... 355/326–328, 355/251, 253, 245; 118/657, 658, 645

[56] References Cited

U.S. PATENT DOCUMENTS

| | | | |
|---|---|---|---|
| 4,752,802 | 6/1988 | Ito et al. | 355/3 DD |
| 4,771,311 | 9/1988 | Bray | 355/3 DD |
| 4,801,966 | 1/1989 | Ikeda | 355/4 |

FOREIGN PATENT DOCUMENTS

| | | | |
|---|---|---|---|
| 62-127878 | 6/1987 | Japan | 355/251 |

*Primary Examiner*—Joan H. Pendegrass

*Attorney, Agent, or Firm*—H. Fleischer; J. E. Beck; R. Zibelli

[57] ABSTRACT

An apparatus which develops a latent image recorded on a photoconductive member with developer material. The developer material is transported by a tubular member into a development zone. Developer material is attracted to the surface of the tubular member by a stationary magnet. A movable magnet translates from an operative position, wherein the magnet generates a weak magnetic field in the development zone, and a non-operative position, wherein the magnet generates a strong magnetic field in the development zone. In the operative position, the weak magnetic field releases the developer material from the surface of the tubular member so that the latent image attracts the developer material thereto. In the non-operative position, the strong magnetic field attracts the developer material to the surface of the tubular member preventing development of the latent image.

18 Claims, 5 Drawing Sheets

LINEARLY MOVABLE DEVELOPER UNIT MAGNET

This invention relates generally to an electrophotographic printing machine, and more particularly concerns energizing and de-energizing selected developer units of the electrophotographic printing machine to produce highlight color copies.

In the process of electrophotographic printing, a photoconductive surface is charged to a substantially uniform potential. The photoconductive surface is image wise exposed to record an electrostatic latent image corresponding to the informational areas of an original document being reproduced. This records an electrostatic latent image on the photoconductive surface corresponding to the informational areas contained within the original document. Thereafter, a developer material is transported into contact with the electrostatic latent image. Toner particles are attracted from the carrier granules of the developer material onto the latent image. The resultant toner powder image is then transferred from the photoconductive surface to a copy sheet and permanently affixed thereto. The foregoing generally describes a typical black and white electrophotographic copying machine.

Recently, electrophotographic printing machines have been developed which produce highlight color copies. A typical highlight color printing machine records successive electrostatic latent images on the photoconductive surface. When combined, these electrostatic latent images form a total latent image corresponding to the entire original document being reproduced. One latent image is usually developed with black toner particles. The other latent image is developed with color highlighting toner particles, e.g. red toner particles. These developed toner images are transferred to the copy sheet to form the color highlighted copy. In order to prevent comingling of the different color developer materials, one developer unit must be non-operative when the other developer unit is operative.

It is clear that in a highlight color printing machine, the change of developer units must be completed in a very short time to change colors between successive latent images. In electrophotographic printing, there is a space between successive latent images recorded on the photoconductive member. Developer units should be changed in the time required for that space to move through the development zone. For example, in a 30 inch/second printing machine having a 1.5 inch space between adjacent latent images, 50 milliseconds are available to change developer units, i.e. colors. During that time the flow of developer material of one color must be completely stopped and the flow developer material of the other color developer material must completely restored. Developer units have been improved by wrapping the photoconductive belt about a portion of the developer roller to form an extended development zone. The magnetic field in the center of the development zone is weak so that the developer material will be readily released from the developer roller and agitated adjacent the latent image recorded on the photoconductive belt. This developer material is then attracted to the latent image. In order to be able to use this type of a development system in a highlight color electrophotographic printing machine, development must be shut-off rapidly, and the photoconductive belt moved away from the developer roller or the developer roller away from the photoconductive belt. A similar problem is encountered in full color copiers. To overcome this problem, the developer housing has been mounted movably in the printing machine. One developer housing is positioned in the operative location with the other developer housings being spaced from the photoconductive surface. In this way, successive developer housings are located adjacent the photoconductive surface to develop the electrostatic latent image recorded thereon with the other developer housings being spaced therefrom. An electrophotographic printing machine using the type of development system is the Model No. 6500 made by the Xerox Corporation. A system of this type is rather complex and requires that each developer housing be mounted movably. It is desirable to maintain the developer housing fixed with respect to the photoconductive surface and to divert the developer material away from the non-operative developer rollers rather than moving the developer housing. The following disclosures appear to be relevant:

U.S. Pat. No. 4,752,802; Patentee: Ito et al.; Issued: June 21, 1988.

U.S. Pat. No. 4,771,311; Patentee: Bray; Issued: Sept. 13, 1988.

U.S. Pat. No. 4,801,966; Patentee: Ikeda; Issued: Jan. 31, 1989.

The relevant portions of the foregoing patents may be briefly summarized as follows:

U.S. Pat. No. 4,752,802 describes a developer roller having a rotating sleeve and a cylindrical magnet disposed interiorly thereof. A level regulating plate removes developer material from the sleeve. During development, the level regulating plate is opposed from a magnetic pole. During non-development, the sleeve is stationary and the magnet is rotated to position a non-magnetized portion of the magnet opposed from the leveling plate. This forms a region on the sleeve having no developer material. The sleeve is then rotated to position the region of the sleeve having no developer material thereon in the development zone to terminate development. In this way, one developer unit may be operational with the other unit being non-operational.

U.S. Pat. No. 4,771,311 discloses a developer roller for transporting developer material adjacent the photoconductive drum and a diverter roller. The developer roller is magnetically coupled to the diverter roller. In the operative mode, the diverter roller is oriented so that there is a weak magnetic field between the diverter roller and the developer roller causing the developer material remain adhering to the the developer roller to advance to the latent image recorded on the photoconductive drum. In the non-operative mode, the diverter roller is oriented so that there is a strong magnetic field between the diverter roller and the developer roller causing the developer material to be attracted from the developer roller to the diverter roller so as to prevent development of the latent image.

U.S. Pat. No. 4,801,966 describes an electrophotographic printing machine having two developer units. One unit is in the operative position with the other unit being in the non-operative position. Motor driven eccentric cams move the developer unit between the operative and non-operative positions.

In accordance with one aspect of the present invention, there is provided an apparatus for developing a latent image recorded on a member with developer material. The apparatus includes means for transporting the developer material into a development zone so as to develop the latent image recorded on the member with developer material. Means, in the non-operative mode, attract the developer material to transporting means in the development zone to prevent development of the latent image recorded on the member. In the operative mode, the attracting means releases the developer material in the developement zone from the transporting means so that the latent image attracts the developer material thereto.

Pursuant to another aspect of the present invention, there is provided an electrophotographic printing machine adapted to have an electrostatic latent image recorded on a photoconductive member developed with developer material. The improvement includes means, for transporting the developer material into a development zone so as to develop the latent image recorded on the photoconductive member with developer material. Means, in the non-operative mode, attract the developer material to the transporting means in the development zone to prevent development of the latent image recorded on the photoconductive member. In the operative mode, the attracting means releases the developer material in the developement zone from the transporting means so that the latent image attracts the developer material thereto.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
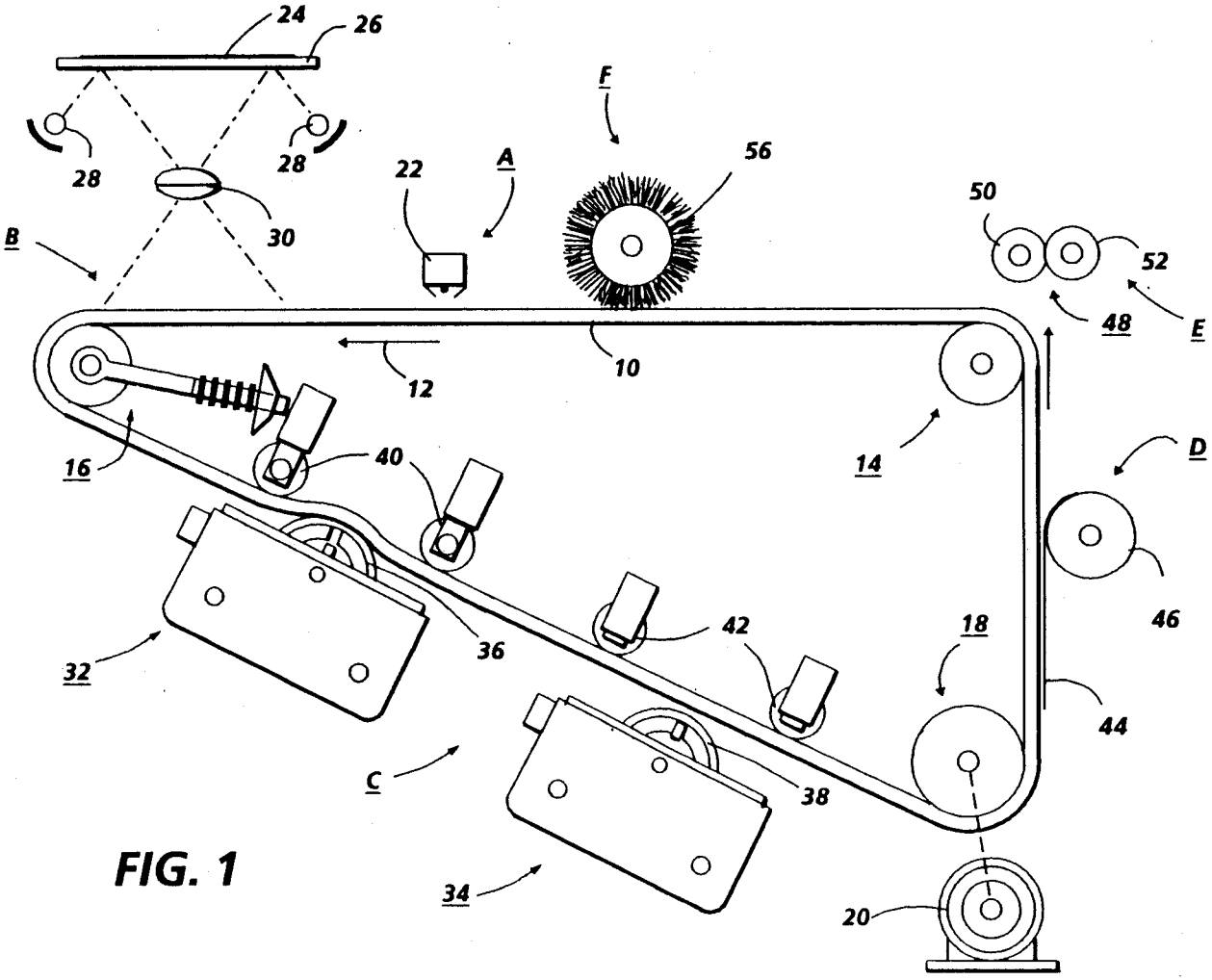
FIG. 1 is a schematic elevational view of an illustrative electrophotographic printing machine incorporating the developer units of the present invention therein.

For a general understanding of the illustrative electrophotographic printing machine incorporating the features of the present invention therein, reference is made to the drawings. In the drawings, like reference numerals have been used throughout to designate identical elements. FIG. 1 schematically depicts the various components of the electrophotographic printing machine incorporating the developer units of the present invention therein. Although the developer units of the present invention are particularly well adapted for use in the illustrative printing machine, it will become evident that these developer units are equally well suited for use individually or together in a wide variety of electrostatographic printing machines and are not necessarily limited in their application to the particular embodiments shown herein.

Referring now to FIG. 1, the electrophotographic printing machine employs a belt 10 having a photoconductive surface deposited on a conductive substrate. Preferably, the photoconductive surface is made from a selenium alloy with the conductive substrate being made preferably from an electrically grounded aluminum alloy. Belt 10 moves in the direction of arrow 12 to advance successive portions of the photoconductive surface sequentially through the various processing stations disposed about the path of movement thereof. Belt 10 is entrained about stripping roller 14, tensioning roller 16 and drive roller 18. Drive roller 18 is mounted rotatably in engagement with belt 10. Motor 20 rotates roller 18 to advance belt 10 in the direction of arrow 12. Belt 10 is maintained in tension by a pair of springs resiliently urging tensioning roller 16 against belt 10 with the desired spring force. Stripping roller 18 and tensioning roller 20 are mounted to rotate freely.

Initially, belt 10 passes through charging station A. At charging station A, a corona generating device, indicated generally by the reference numeral 22 charges the photoconductive surface of belt 10 to a relatively high, substantially uniform potential. The charged photoconductive surface is next advanced through exposure station B.

At exposure station B, an original document 24 is positioned face down upon transparent platen 26. Lamps 28 flash light rays onto original document 24. The light rays reflected from original document 24 are transmitted through lens 30 forming a light image thereof. Lens 30 focuses the light image onto the charged photoconductive surface to selectively dissipate the charge thereon. This records an electrostatic latent image on the photoconductive surface which corresponds to the informational areas contained within original document 24. Although an optical system has been described as forming the light image of the information used to selectively discharge the charged photoconductive surface, one skilled in the art will appreciate that a modulated beam of energy, e.g. a laser beam, may be used to irradiate the charged portion of the photoconductive surface to record an electrostatic latent image thereon. After the first electrostatic latent image is recorded on the photoconductive surface, the foregoing process is repeated to record a second electrostatic latent image thereon. The first electrostatic latent image is separated from the second electrostatic latent image on the photoconductive surface by an inter-image space. Thus, successive electrostatic latent images containing different information are recorded on photoconductive surface 12. The first electrostatic latent image is developed with developer material of one color and the second electrostatic latent image is developed with developer material of another color. Typically, one of the colors is black with the other color being a highlight color, such as red. The differently colored developed images are transferred to a common sheet to form a copy having two colors thereon, i.e. black and red indicia.

After exposure, belt 10 advances the latent images to development station C. Development station C includes two developer units indicated generally by the reference numerals 32 and 34, respectively. Developer unit 32 is adapted to develop the first electrostatic latent image with black developer material. Developer unit 34 is adapted to develop the second electrostatic latent image with a highlight color developer material, e.g. a red developer material. When developer unit 32 is operative, developer unit 34 is non-operative. For example, when developer unit 32 is developing the first electrostatic latent image with black developer material, developer unit 34 is non-operative. Conversely, when developer unit 34 is developing the second electrostatic latent image with a highlight color developer material, developer unit 32 is non-operative. Each developer unit includes a magnetic brush developer roller 36 and 38, respectively. FIG. 1 depicts developer unit 32 in the operative mode and developer unit 34 in the non-operative mode. Developer roller 36 of developer unit 32 transports a brush of developer material comprising magnetic carrier granules and toner particles into contact with belt 10. Idler rollers 40 position belt 10 such that it wraps about a portion of the the exterior circumferential surface of developer roller 36 to form an extended development zone. The latent image attracts toner particles from the carrier granules forming a toner powder image thereon. Idler rollers 40 are movable and, in the non-operative mode, translate idler rollers 40 away from the backside of belt 10. Belt 10 moves away from developer roller 36 and is spaced therefrom The foregoing is shown with respect to developer unit 34. As illustrated, idler rollers 42 are translated away from belt 10 allowing belt 10 to move away from developer roller 38. In the non-operative mode, belt 10 is spaced from developer roller 38. In the operative mode, as illustrated by developer unit 32, a weak magnetic field is generated in the development zone releasing the developer material from the developer roller and permitting the latent image to more readily attract the toner particles thereto. In contradistinction, in the non-operative mode, as illustrated by developer unit 34, a strong magnetic field is generated in the development zone strongly attracting the developer material to the surface of the developer roller preventing development of the latent image and developer loss by centrifugal forces. Developer units 32 and 34 are identical to one another, the only difference being the color of the toner particles contained therein. Developer unit 32 uses black toner particles while developer unit 34 uses red toner particles. Inasmuch as the developer units are identical, only developer unit 32 will be described hereinafter in greater detail with reference to FIGS. 2 through 7, inclusive.

With continued reference to FIG. 1, after the electrostatic latent image is developed, belt 10 advances the toner powder image to transfer station D. A sheet 44 is advanced to transfer station D by a sheet feeding apparatus. Preferably, the sheet feeding apparatus includes a feed roll contacting the uppermost sheet of the stack of sheets. The feed roll rotates to advance the uppermost sheet from the stack into a chute. The chute directs the advancing sheet into contact with the photoconductive surface of belt 10 in a timed sequence so that the toner powder image formed thereon contacts the advancing sheet at transfer station D. Transfer station D includes an electrically biased transfer roll which has sheet grippers to releasably secure sheet 44 thereto. Sheet 44 moves in a recirculating path on the surface of roll 46. Roll 44 is electrically biased to a voltage having a suitable magnitude and polarity sufficient to attract the toner powder image from the photoconductive surface to sheet 44. Thus, as the sheet passes through the nip defined by belt 10 and roller 46, the first toner powder image, i.e. the black toner powder image, is transferred from the photoconductive surface to sheet 44. Sheet 44 remains adhering to the surface of roller 46 for another cycle. Once again, the sheet passes through the nip defined by belt 10 and roller 46. As the sheet passes through the nip, the second toner powder image, i.e. the red toner powder image, is transferred thereto. Thus, a black toner powder image and a red toner powder image are transferred to sheet 44 forming a color highlighted copy. After transfer, sheet 44 is released from roll 46 and advances to fusing station E.

Fusing station E includes a fuser assembly, indicated generally by the reference numeral 48, which permanently affixes the transferred powder images to sheet 44. Preferably, fuser assembly 48 has a heated fuser roller 50 and back-up roller 52. Sheet 44 passes between fuser roller 50 and back-up roller 52 with the toner powder images contacting fuser roller 50. In this manner, the toner powder images are permanently affixed to sheet 44. After fusing, sheet 44 is advanced to a catch tray for subsequent removal from the printing machine by the operator.

After the sheet of support material is separated from the photoconductive surface of belt 10, the residual toner particles adhering to the photoconductive surface are removed therefrom at cleaning station F. Cleaning station F includes a rotatably mounted fibrous brush 52 in contact with the photoconductive surface. The particles are cleaned from the photoconductive surface by the rotation of brush 56 in contact therewith. Subsequent to cleaning, a discharge lamp (not shown) floods the photoconductive surface with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the developer units of the present invention therein.

Figure 2:
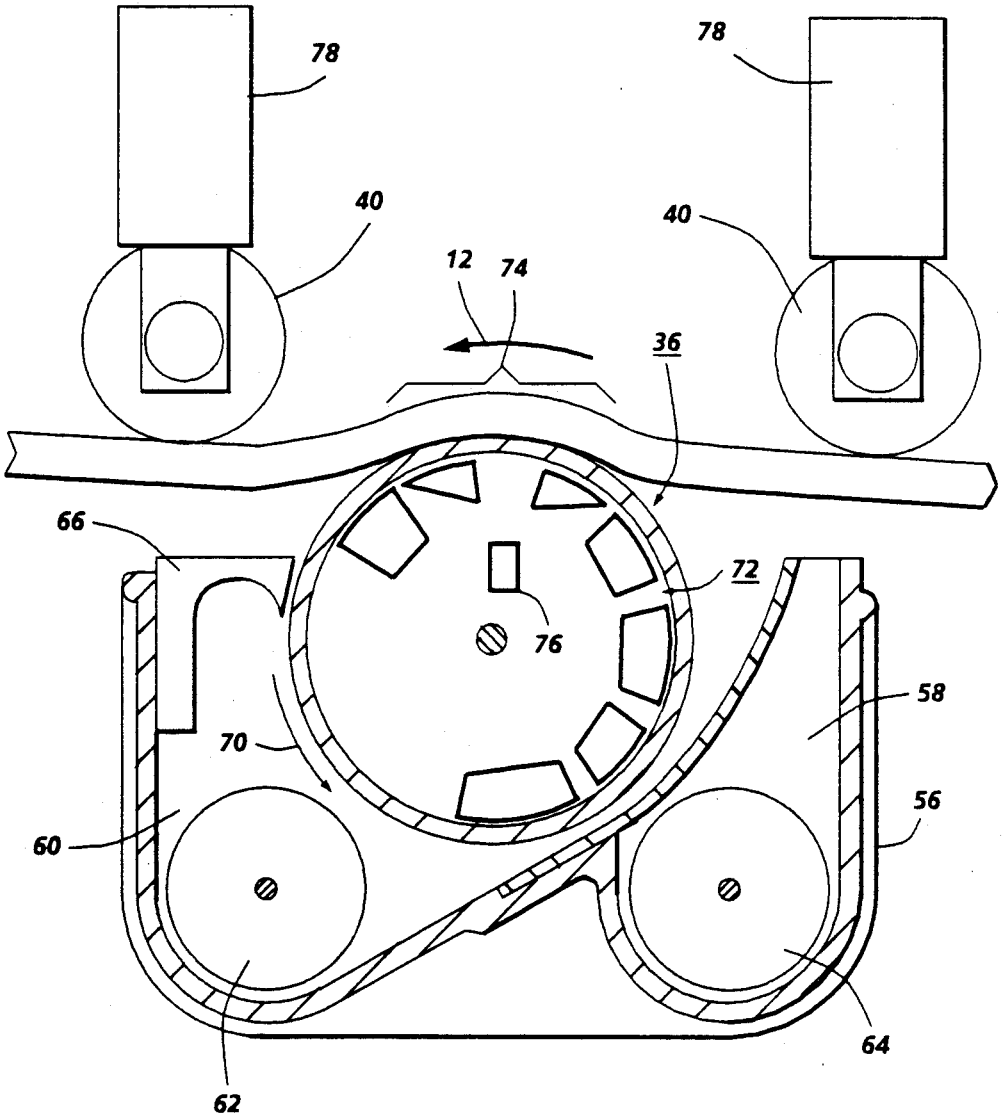
FIG. 2 is an elevational view showing one of the developer units used in the FIG. 1 printing machine.

Referring now to the specific subject matter of the present invention, FIG. 2, shows developer unit 32 in greater detail. Developer unit 32 includes a housing 56 defining chambers 58 and 60 for storing a supply of developer material therein. Augers 62 and 64 mix the developer material in chambers 60 and 58 of housing 56 and advance the developer material to developer roller 36. Developer roller 36 advances the black developer material into contact with the first electrostatic latent image recorded on the photoconductive surface of belt 10. A trim bar 66 regulates the thickness of the developer pile height on developer roller 36. Developer roller 36 includes a non-magnetic tubular member 68 preferably made from aluminum having the exterior surface thereof roughened. Tubular member 68 rotates in the direction of arrow 70. An arcuate magnet 72 is mounted interiorly of tubular member 68 and spaced therefrom. Magnet 72 is stationary and positioned to attract the developer material to the exterior circumferential surface of tubular member 68. In this way, as tubular member 68 rotates in the direction of arrow 70, developer material is attracted to the exterior circumferential surface and moved therewith into development zone 74. A movable magnet 76 is positioned interiorly of tubular member 66 opposed from development zone 74. Magnet 76 moves from the operative position spaced from the development zone to the non-operative position adjacent the development zone. In this way, magnet 76 generates a weak magnetic field in development zone 74 when in the operative position. The developer material on tubular member 68 passing through development zone 74 is released from the exterior circumferential surface of tubular member 68 and is highly agitated. When magnet 76 moves to the non-operative position, it generates a strong magnetic field in development zone 74. Simultaneously, solenoids 78 retract idler rollers 40 away from belt 10. This spaces belt 10 from the exterior circumferential surface of tubular member 68. When in the operative position, solenoids 78 press idler rollers 40 against belt 10 to wrap belt 10 about a portion of the exterior circumferential surface of tubular member 68. By way of example, belt 10 may be wrapped about the exterior circumferential surface of tubular member 68 an angle ranging from about 5° to about 25°. The strong magnetic field being generated by magnet 76 in development zone 74 strongly attracts the developer material to the exterior circumferential surface of tubular member 68 to prevent development of the electrostatic latent image recorded on belt 10 and/or loss of developer material by centrifugal forces. Developer unit 34 (FIG. 1) is shown in the non-operative position. By way of example, both magnets 72 and 76 are made from barium ferrite having magnetic poles impressed on the surfaces thereof. Tubular member 68 is electrically biased by a voltage source (not shown) to a suitable polarity and magnitude. The voltage level is intermediate that of the background voltage level and the image voltage level recorded on the photoconductive surface of belt 10. After the first electrostatic latent image has been developed, developer unit 32 becomes non-operative and developer unit 34 becomes operative.

Figure 3:
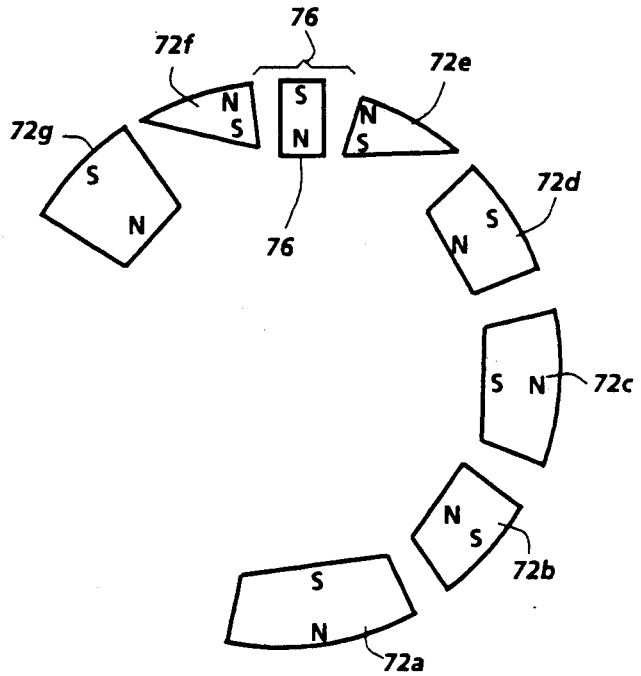
FIG. 3 is a schematic elevational view illustrating the magnetic pole arrangement of the magnets of the the FIG. 2 developer unit in the non-operative mode.
Figure 4:
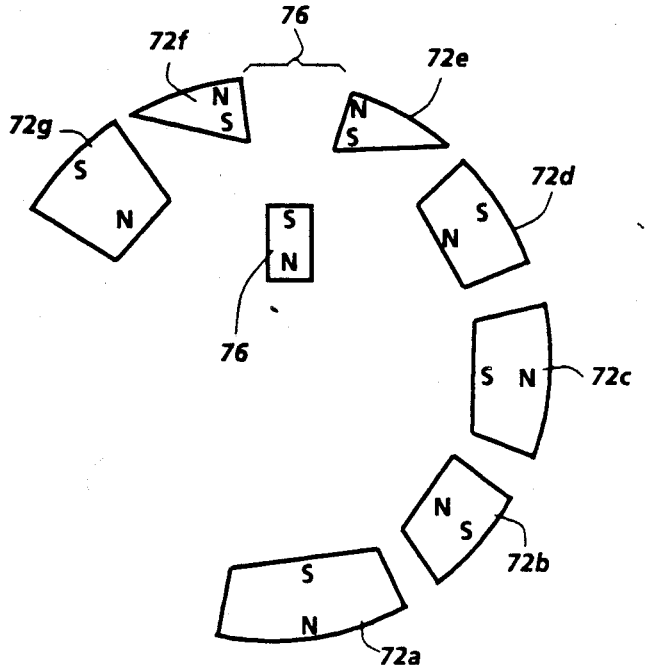
FIG. 4 is a schematic elevational view showing the magnetic pole arrangement of the magnets of the the FIG. 2 developer unit in the operative mode.

Turning now to FIGS. 3 and 4, there is shown arcuate magnet 72 in the non-operative position and the operative position. Preferably magnet 72 includes a plurality of spaced magnets *72a*, *72b*, *72c*, *72d*, *72e*, *72f*, and *72g*. These magnets are mounted on a fixed, non-magnetic support. Thus, magnets *72a*, *72b*, *72c*, *72d*, *72e*, *72f*, and *72g* are stationary. Magnet 76 is movable between the non-operative position (FIG. 3) and the operative position (FIG. 4). In the non-operative position, magnet 76 is adjacent development zone 74 (FIG. 2) and generates a strong magnetic field in development zone 74 preventing development of the latent image recorded on the photoconductive surface of belt 10. When magnet 76 is in the operative position, it is located remotely from development zone 74 and generates a weak magnetic field in development zone 74 facilitating development of the electrostatic latent image recorded on the photoconductive surface of belt 10. Developer material is picked up by magnet *72a*. Trim bar 66 is positioned opposed from magnet *72c*. Development zone 74 is located between magnets *72e* and *72f*. Magnets *72e* and *72f* have the same polarity, i.e., both are north poles. Since these magnets have same polarity on the exterior surface, there is only a small or weak magnetic field between these magnets in development zone 74. The direction of magnetization is always perpendicular to the base surface of each magnet. The direction and shape of the magnets *72e* and *72f* are adjusted to compensate for the field perturbation by a small magnet 76. Switching from the operative mode to the non-operative mode is accomplished by moving magnet 76 into the position between magnets *72e* and *72f*. Since the polarity of magnet 76 is opposite to the polarity of magnets *72e* and *72f*, i.e. south, the intensity of the magnetic field generated in development zone 74 is increased sufficiently to prevent the developer material from being released from tubular member 68 by the centrifugal forces applied thereon as tubular member 68 rotates. By way of example, the diameter of the outer surface of the magnets is 59 millimeters. The nominal exterior diameter of the developer roll is 63 millimeters. Magnet 76 is 6 millimeters wide and 7 millimeters high. The permanent magnetization of magnets *72a*, *72b*, *72c*, *72d*, *72e*, and *72f* is 2.4 kilo gauss. The permanent magnetization of magnets *72g* and 76 is 2.8 kilo gauss. The travel of magnet 76 between the operative and non-operative positions is 10.5 millimeters.

Figure 5:
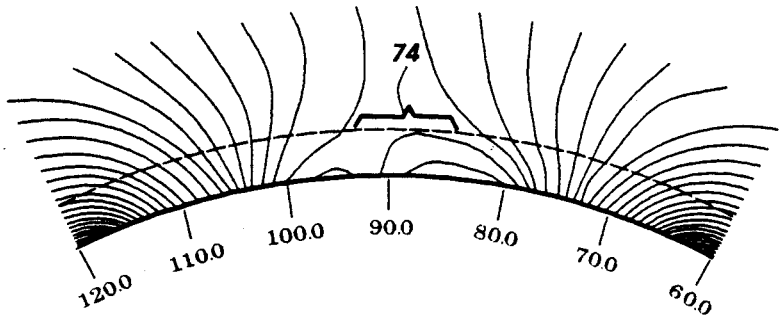
FIG. 5 is a fragmentary, schematic elevational view depicting the magnetic field pattern generated by the FIG. 4 magnetic pole arrangement.
Figure 6:
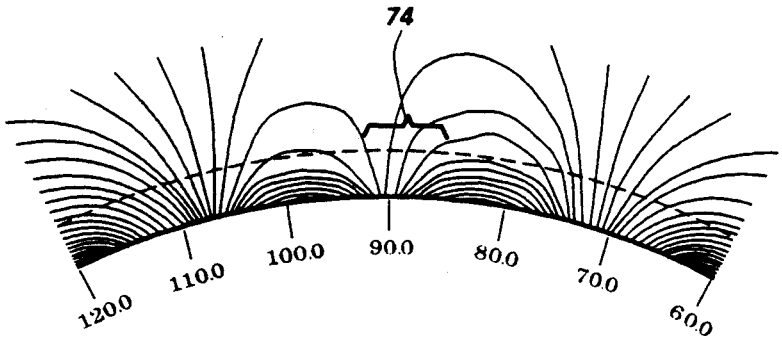
FIG. 6 is a fragmentary, schematic elevational view showing the magnetic field pattern generated by the FIG. 3 magnetic pole arrangement.

Referring now to FIGS. 5 and 6, there is shown the profile of the magnetic field lines. The center of development zone 74 is at 90°. FIG. 5 illustrates magnetic field lines for the operative mode with FIG. 6 depicting the magnetic field lines for the non-operative mode. Inasmuch as the centrifugal force exerted on the developer material is in the opposite direction to the magnetic attractive force, the maximum speed that the tubular member 68 can rotate without causing the developer material to fly off is a function of the intensity of the magnetic field being generated in the development zone. As shown in FIG. 6 for a reasonable speed for a 200 copy/minute development process, no developer material is released from the surface of the tubular member when magnet 76 is in the non-operative position. On the other hand, when magnet 76 is in the operative position, the intensity of the magnetic field in development zone 74 is reduced and the developer material released from the surface of tubular member 68. The released developer material is agitated and attracted to the latent image. Thus, in the operative mode the latent image is developed whereas in the non-operative mode, the latent image is not developed.

Figure 7:
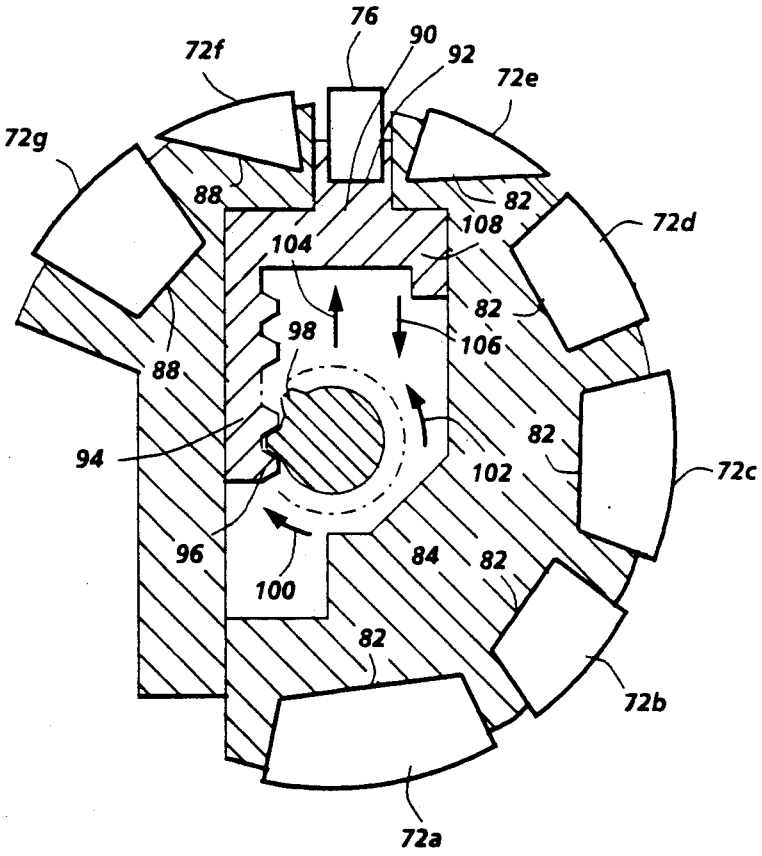
FIG. 7 illustrates an exemplary structure for moving the magnet of the FIG. 2 developer unit between the operative and non-operative positions.

FIG. 7 shows the details of the developer roller magnets. As shown thereat, magnets *72a*, *72b*, *72c*, *72d* and *72e* are mounted fixedly on non-magnetic support 80. Support 80 has recessed portions or cups 82 configured in the shape of the respective magnet to receive and hold the magnet therein. The magnets are cemented in the respective cups. Preferably, support 80 is made from a suitable non-magnetic material, such as stainless steel. Support 80 is mounted stationarily on shaft 84. Magnets *72f* and *72g* are mounted on support 86. Support 86 also has cups 88 therein. Cups 88 are suitably configured to receive magnets *72f* and *72g* therein. The magnets are cemented in the respective cup. Support 86 is also mounted stationarily on shaft 84. Magnet 76 is mounted on movable support 90. Support 90 has a cup 92 therein configured to receive magnet 76 therein. Magnet 76 is mounted in cup 90. Leg 94 of support 90 has gear teeth 96 meshing with gear teeth 98 on shaft 84. In this way, leg 94 and shaft 84 serve as a rack and pinion gear, respectively. Shaft 84 rotates in the direction of arrow 100 causing teeth 98 meshing with teeth 96 on leg 94 to move support 90 in the direction of arrow 104 until flange 108 contacts 80 and 86. This moves magnet 76 from the operative position to the non-operative position. Shaft 84 rotates in the direction of arrow 102 to move support 90 in the direction of arrow 106. This moves magnet 76 from the non-operative position to the operative position. A suitable motor is coupled to shaft 84 and rotates shaft 84 in response to a control signal from the printing machine control logic. It is thus clear the rotation of shaft 84 moves magnet between the operative and non-operative positions.

In recapitulation, the developer unit of the present invention employs a translatable magnet which is positioned adjacent the development zone in the non-operative mode to exert a strong magnetic field in the development zone preventing development of the latent image. In the operative mode, the magnet is translated to the operative position remote from the development zone to exert a weak magnetic field in the magnetic zone permitting the centrifugal and shearing forces exerted on the developer material to release the developer material from the developer roller and agitate the toner particles so that the toner particles are attracted to the latent image, thereby developing the latent image.

It is, therefore, apparent that there has been provided in accordance with the present invention, a developer unit for use in an electrophotographic printing machine that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for developing a latent image recorded on a member with developer material, including:

means for transporting the developer material into a development zone so as to develop the latent image recorded on the member with developer material;

a magnet operatively associated with said transporting means to attract developer material thereto in a non-operative position and to release developer material therefrom in an operative position; and means for moving said magnet between an operative position, wherein said magnet generates a weak magnetic field in the development zone, and a non-operative position, wherein said magnet generates a strong magnet field in the development zone.

2. An apparatus according to claim 1, wherein said transporting means includes a tubular member having said magnet disposed interiorly thereof and spaced therefrom.

3. An apparatus according to claim 2, further including an arcuate magnet positioned disposed interiorly of said tubular member.

4. An apparatus according to claim 3, wherein said moving means translates said magnet between the non-operative position and the operative position with the non-operative position being adjacent the development zone and the operative position remote therefrom.

5. An apparatus according to claim 4, wherein said arcuate magnet is stationary.

6. An apparatus according to claim 2, wherein the member is a flexible belt.

7. An apparatus according to claim 6, further including means for wrapping the flexible about a portion of the exterior circumferential surface of said tubular member to form an extended development zone.

8. An apparatus according to claim 7, wherein said wrapping means wraps the flexible belt about the exterior circumferential surface of said tubular member in response to said moving means moving said magnet from the non-operative position to the operative position.

9. An apparatus according to claim 8, wherein said wrapping means spaces the flexible belt from the exterior circumferential surface of said tubular member in response to said moving means moving said magnet from the operative position to the non-operative position.

10. An electrophotographic printing machine adapted to have an electrostatic latent image recorded on a photoconductive member developed with developer material, wherein the improvement includes:

means, for transporting the developer material into a development zone so as to develop the latent image recorded on the photoconductive member with developer material;

a magnet operatively associated with said transporting means to attract developer material thereto in a non-operative position and to release developer material therefrom in an operative position; and means for moving said magnet between an operative position, wherein said magnet generates a weak magnetic field in the development zone, and a non-operative position, wherein said magnet generates a strong magnet field in the development zone.

11. A printing machine according to claim 10, wherein said transporting means includes a tubular member having said magnet disposed interiorly thereof and spaced therefrom.

12. A printing machine according to claim 11, further including an arcuate magnet positioned disposed interiorly of said tubular member.

13. A printing machine according to claim 12, wherein said moving means translates said magnet between the non-operative position and the operative position with the non-operative position being adjacent the development zone and the operative position remote therefrom.

14. A printing machine according to claim 13, wherein said arcuate magnet is stationary.

15. A printing machine according to claim 11, wherein the photoconductive member is a flexible belt.

16. A printing machine according to claim 15, further including means for wrapping the flexible belt about a portion of the exterior circumferential surface of said tubular member to form an extended development zone.

17. A printing machine according to claim 16, wherein said wrapping means wraps the flexible belt about the exterior circumferential surface of said tubular member in response to said moving means moving said magnet from the non-operative position to the operative position.

18. A printing machine according to claim 17, wherein said wrapping means spaces the flexible belt from the exterior circumferential surface of said tubular member in response to said moving means moving said magnet from the operative position to the non-operative position.

* * * * *